US005845722A

United States Patent [19]

Makohl et al.

[11] Patent Number: 5,845,722

[45] Date of Patent: Dec. 8, 1998

[54] METHOD AND APPARATUS FOR DRILLING BOREHOLES IN EARTH FORMATIONS (DRILLS IN LINER SYSTEMS)

[75] Inventors: Friedheim Makohl, Hermannsburg; Carsten Vogt, Celle, both of Germany; Surwano Pudjihanto, Jakarta Senatan, India

[73] Assignee: Baker Hughes Incorporated, Houston, Tex.

[21] Appl. No.: 729,226

[22] Filed: Oct. 9, 1996

[30] Foreign Application Priority Data

Oct. 9, 1995 [EP] European Pat. Off. ..... 95 115 867

[51] Int. Cl.[6] ..... E21B 7/20

[52] U.S. Cl. ..... 175/101; 175/171; 175/257

[58] Field of Search ..... 175/101, 106, 175/107, 257, 171

[56] References Cited

U.S. PATENT DOCUMENTS

| | | | |
|---|---|---|---|
| 3,732,143 | 5/1973 | Joosse | 175/101 X |
| 3,901,331 | 8/1975 | Djurovic | 175/101 X |
| 4,842,081 | 6/1989 | Parant | 175/101 X |
| 5,186,265 | 2/1993 | Henson et al. | 175/107 |
| 5,197,553 | 3/1993 | Leturno | 175/57 |
| 5,472,057 | 12/1995 | Winfree | 175/101 X |

FOREIGN PATENT DOCUMENTS

| | | |
|---|---|---|
| 0 265 344 | 4/1988 | European Pat. Off. . |
| 0 462 618 | 12/1991 | European Pat. Off. . |
| 3839760 | 1/1990 | Germany . |
| 3902868 | 6/1990 | Germany . |

*Primary Examiner*—David J. Bagnell
*Attorney, Agent, or Firm*—Madan & Morris, PLLC

[57] ABSTRACT

A method of sinking a bore hole in underground formations which have at least one special stratiform formation which features vastly differing formation pressures in respect to a formation adjacent to it in the sinking direction and in which a drilling tool carried at the bottom end of a drill line and having a drill bit driven by a deep drilling motor drills out a first part of a bore hole which extends to a point close to the boundary area of the special formation, characterized in that upon subsequent sinking of a further part of the bore hole by the casing string which passes through at least one special formation, a tubular outer casing with a bottom end carrying a driven drill head is entrained, the bore hole being lined by this, at least in the region of the special formation.

21 Claims, 6 Drawing Sheets

METHOD AND APPARATUS FOR DRILLING BOREHOLES IN EARTH FORMATIONS (DRILLS IN LINER SYSTEMS)

The invention relates to a method of and an apparatus for sinking a bore in underground formations with at least one special stratiform formation which features vastly different formation pressures in respect of a formation adjacent to it in the sinking direction.

When a bore which is initially sunk in a first formation at a first formation pressure strikes a second formation of considerably lower formation pressure, for example a porous layer such as is typical in the case of gas and/or oil deposits, then the pressure in the drilling mud drops, in some cases very abruptly, with the result that the pressure equalisation between the formation pressure in the first formation and the pressure of the drilling mud and which previously prevailed in the annular space now ceases to be present and at least parts of the first formation bear on the casing string and may grip it which will entail a loss of bore hole and the main parts of the drilling tool.

If a bore which is initially sunk in a first formation having a first formation pressure strikes a formation of substantially higher formation pressure, then there is the danger of media peculiar to that formation flowing into the drilling mud, passing through the drilling mud and being forced out of the annular space and the casing string on the surface. If the weight of the drilling mud is increased, as can happen as the result of introduction of heavy spar or iron oxide into the drilling mud in order to bring about equalisation for the high pressure of the formation in which a bore has been started, then losses of drilling mud take place in the first formation.

The invention is concerned with the problem of providing a method and a drilling tool which avoid the aforementioned disadvantages when sinking bores in underground formations in which the formation pressures differ considerably.

By jointly carrying an outer casing or liner, this latter absorbs the formation pressures so that the drilling tool remains ready for use and the bore hole can be further used. The outer casing forms a screen vis-a-vis the formation which avoids the occurrence of afflux just as it avoids parts of the formation being pushed onto the drilling tool and casing string.

Further details and advantages will emerge from the ensuing description of the method according to the invention and of the drilling tool according to the invention, two embodiments of which are illustrated in greater detail in the accompanying drawings in which.

Figure 1:
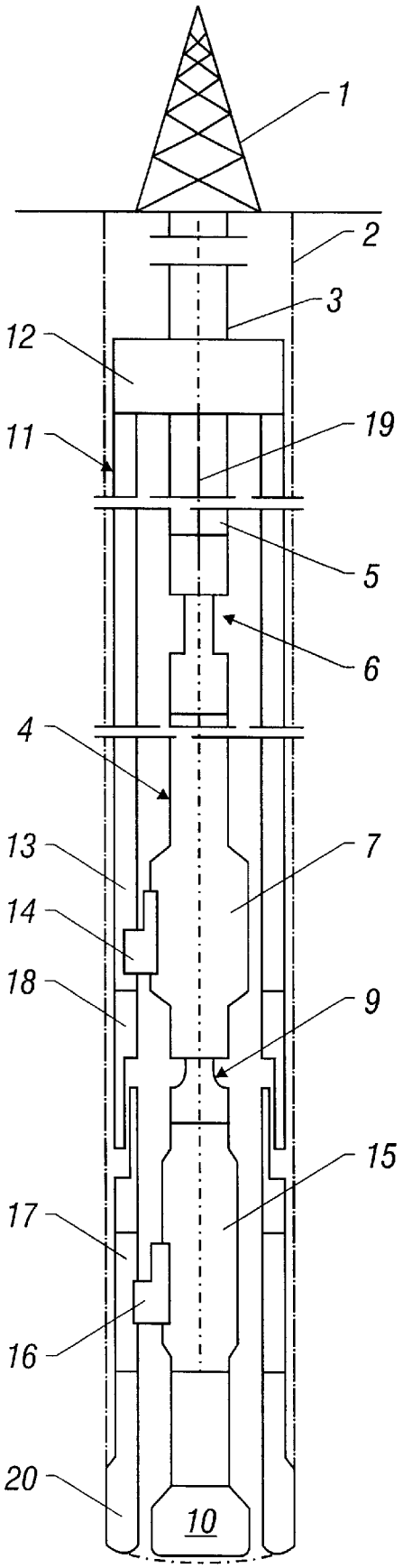
FIG. 1 shows an overall diagrammatic view of a drilling plant with a drilling tool in accordance with the invention.

The drilling plant shown diagrammatically in FIG. 1, for sinking a bore in underground formations, comprises a drilling tower 1 on the surface and comprising the conventional equipment and from which a casing string 3 composed of bolted-together portions of tubing extends downwards in a bore hole 2, the bottom end of which is connected in conventional manner via a connecting screw thread to a drilling tool 4. In this case, as illustrated, it is possible to bolt in between the casing string end 5 and the drilling tool 4 an equalising and pressure device 6 (thruster) by means of which mainly thermally-produced differences in length can be compensated for while maintaining or predetermining a desired bit application force.

The drilling tool 4 comprises a tool casing 7 composed of bolted-together portions of tubing and, accommodated in this casing an only diagrammatically indicated deep drilling motor 8 of any appropriate prior art construction, the output shaft 9 of which is at its bottom end bolted to a drill bit 10.

The plant shown in FIG. 1 further comprises, enclosing the casing string 3 and the drilling tool 4, an outer casing 11 which forms a bore hole liner composed of tube portions and which can at its top end be connected to the casing string 3 via a connecting device (liner hanger) 12. This connecting device 12 constitutes a separable connection to the casing string 3 and makes it possible for the outer casing 11 to be inserted into and withdrawn from the bore hole 2 jointly with the casing string 3.

The tool casing 7 is in the region of the bottom end of the main upper part 3 of the outer casing 11 securely braced against downwards movement by an upper group 14 of locking members and the drive shaft 9 is, in the region of a thickened portion 15, connected by a bottom group 16 of locking members to a separate bottom end part 17 of the outer casing 11 which is independently rotatably mounted on a bottom end portion 18 of the main part 13 of the outer casing 11 and which is able to rotate about the common longitudinal central axis 19 of the drilling tool together with the drive shaft 9. The bottom end part 17 carries at its end a drill head 20 the cutting plane of which occupies a starting position situated substantially at the height of the cutting plane of the drill bit 10.

The upper group 14 of locking members is formed by a locking groove 21 constructed in the outer casing 11 in the form of an outwardly shaped annular pocket and with locking strips 22 which are fixed on the tool housing 7 by means of screws 23 at one end, the free part being adapted to be resiliently deflectable by the action of a spring 24 out of a concealed starting position into a locking position in which the locking strips 22 engage the locking grooves 21 in non-rotatable manner. In this situation and in the case of the fixing of their upper end which is illustrated, the locking strips 22 have their free bottom end resting on the pocket bottom 21'; in the event of the locking strips 22 being fixed at their bottom end, which is also possible, the bracing effect is achieved by a projection of the engagement part 25 at the upper free end of the locking strips 22 on the pocket bottom 21'. The locking strips 22 are in this case subjected to a tensile loading. In terms of locking strips 22, at least three are provided which are regularly distributed over the periphery of the outer casing 11 or tool casing 7.

The bottom group 16 of locking members is formed by longitudinally directed locking grooves 26 constructed in the bottom end part 17 of the outer casing 11 in the form of channel-like outwardly shaped pockets and by locking strips 27 fixed by screws 23 on the thickened portion 15 of the drive shaft 9 of the deep drilling motor 8 and which can likewise, by the action of a spring 28, be resiliently deflected out of a concealed starting position into a locking position in which engagement parts 29 of the locking strips 27 engage the locking grooves 26. The bottom group 16 comprises at least three pairs of locking grooves 26 and locking strips 27 which are equi-angularly distributed over the periphery of outer casing 11 or drive shaft 9. Instead of the illustrated mounting of the locking strips 27 with the fixing point on top while the bottom end is free, they can also be mounted with the free end uppermost and the fixing point underneath.

In order to ensure that the locking strips 27 of the bottom group 16 cannot drop into the locking groove 21 of the top group 14, the locking groove 21 of the top group 14 is constructed with an engagement length which is shorter than the engagement length of the engagement parts 29 of the locking strips 27 of the bottom group 16. This ensures that the engagement parts 29 of the locking strips 27 of the bottom group 16 can only fall into the locking grooves 26 of the bottom group 16 which are intended for them.

Figure 2:
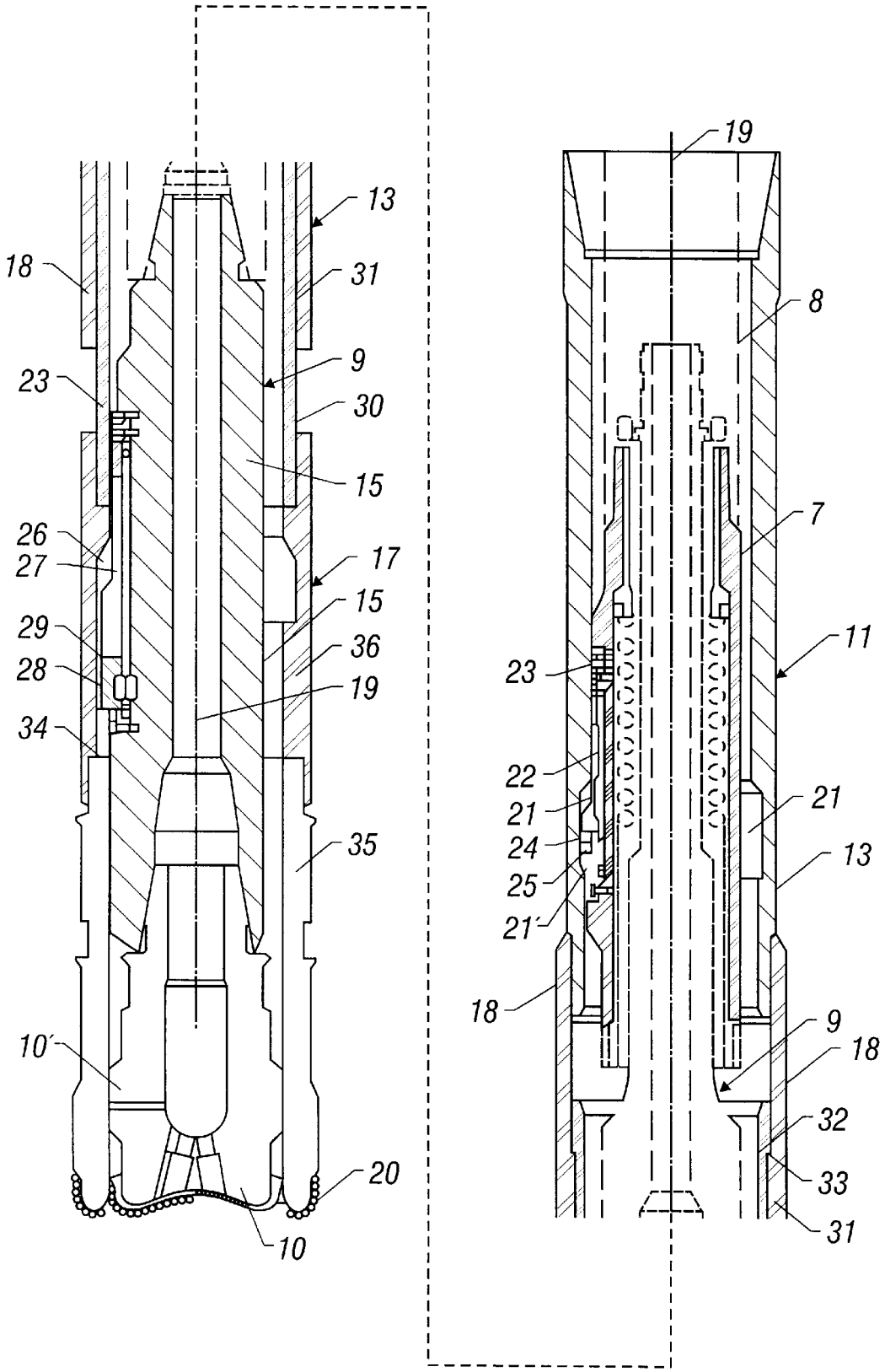
FIG. 2 shows a longitudinal section through a first embodiment of a drilling tool in an extreme low position in a bottom part of an outer casing, sub-divided into two partial views which are adjacent each other.
Figure 3:
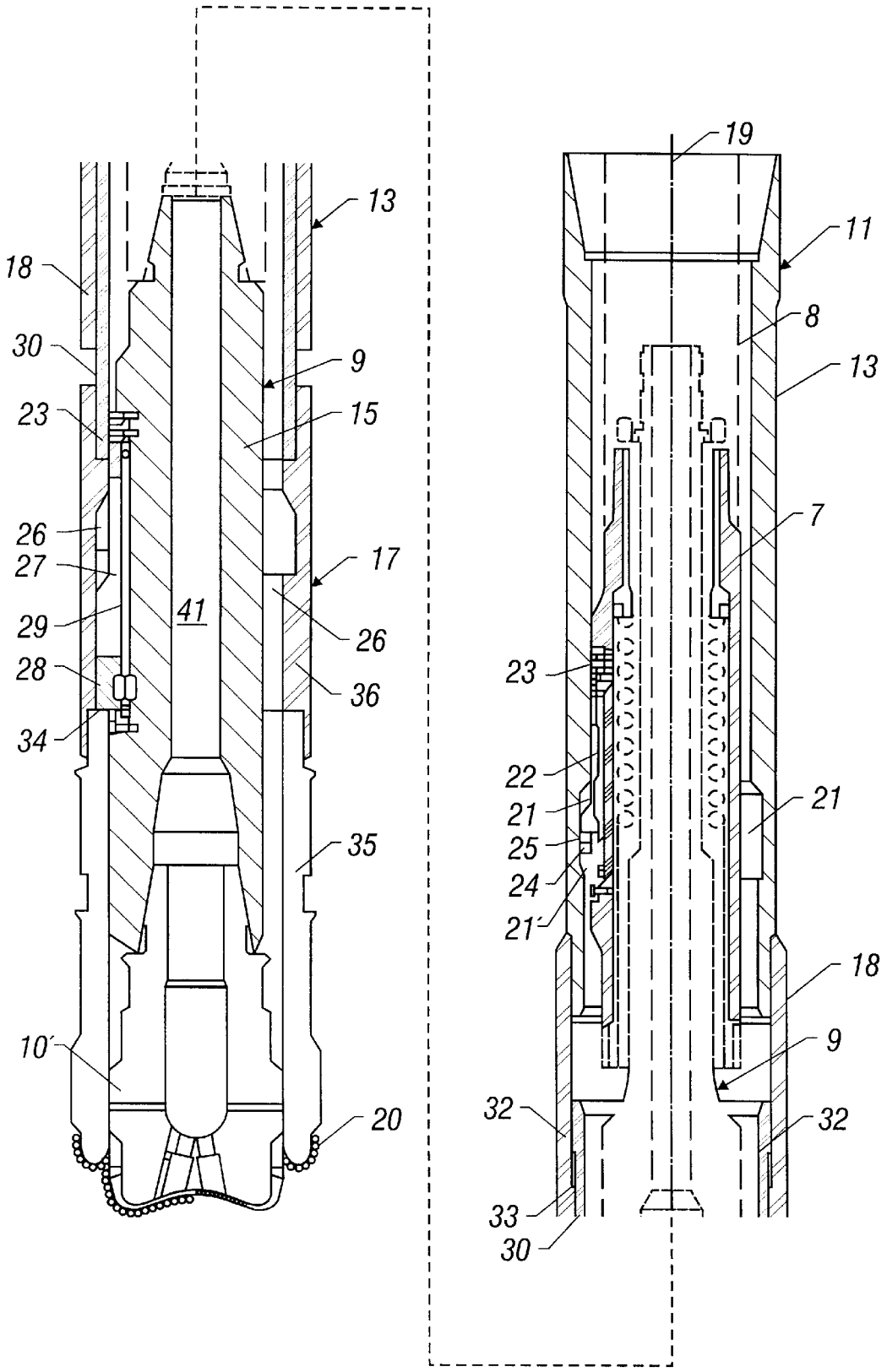
FIG. 3 is an illustration similar to that in FIG. 2, showing the bottom end part of the outer casing in the drilling position.
Figure 4A:
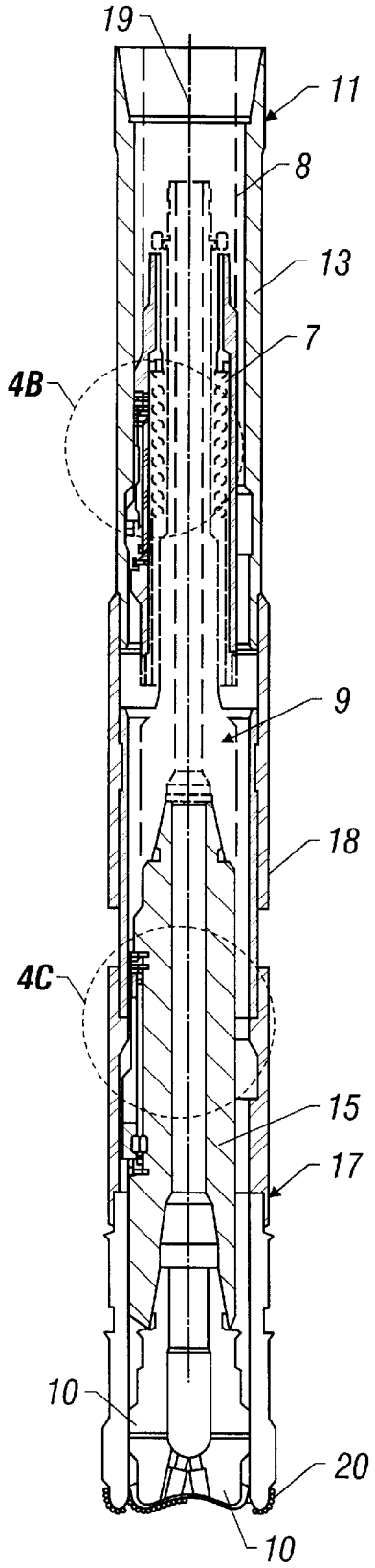
FIG. 4 is a one-part view of the outer casing and drilling tool according to FIG. 2 and with two enlarged detailed views.
Figure 4B:
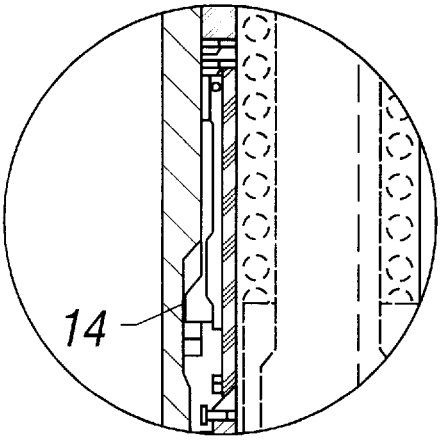
Figure 4C:
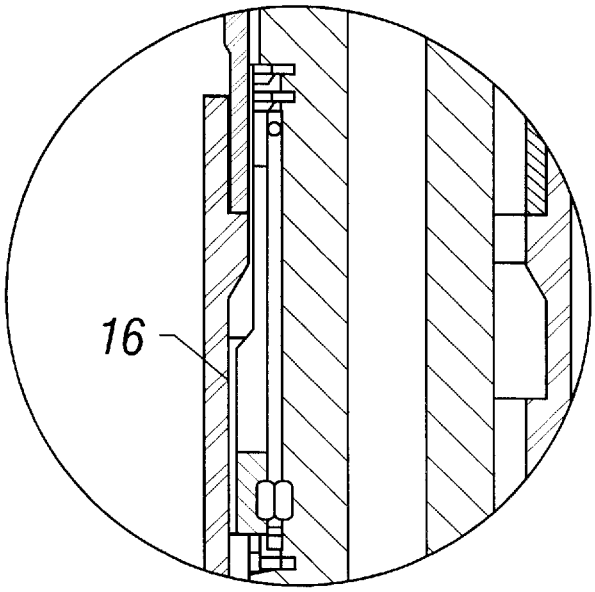

The locking grooves 26 of the bottom group 16 have an engagement length which is greater than that of the engagement parts 29 of the locking strips 27 of the bottom group 16. This ensures that the bottom end part 17 of the outer casing 11 is capable of displacement in an axial direction in relation to the drive shaft 9 and between two extreme positions, as shown in FIGS. 2 and 3. In this respect, the upper extreme position shown in FIG. 3 represents the drilling position in which the cutting plane of the drill head 20 is offset upwardly in respect of that of the drill bit 10 and surrounds the drill bit 10 in the region of its lateral cutting surface. This provides for better dissipation of drilling mud and fines.

For mounting the bottom end part 17 of the main part 13 of the outer casing 11, a bearing sleeve 30 is provided which is inserted from above into the bottom end part 17 of the outer casing 11 and is rigidly connected, for example bolted, thereto. The bottom end portion 18 of the upper main part 13 of the outer casing 11 engages around the bearing sleeve 30 and, with a bearing surface 31 on its inside face, it forms a plain bearing coaxial with the longitudinal central axis 19 through the drilling tool. At the same time, the bearing sleeve 30 is axially displaceably braced in the bottom end portion 18 of the upper main part 13 of the outer casing 11 so that it is possible for the bottom end part 17 to enjoy the already above-mentioned axial mobility between the starting position shown in FIG. 2 and the drilling position shown in FIG. 3.

At its top end, the bearing sleeve 30 has on the outside a shoulder 32 which, as an abutment in conjunction with a shoulder 33 above the bearing surface 31, defines the extreme low position of the bottom end part 17 of the outer casing 11. The drilling position on the other hand is defined by the bottom end of the locking strips 27 which cooperate with a mating surface 34 as an abutment, the said mating surface being in the case of the example illustrated formed by the end face of the screwed-in bottom portion 35 of the bottom end part 17 of the outer casing 11 which is screwed into the upper portion 36 of the bottom end part 17 of the outer casing 11 which is above it.

Figure 5:
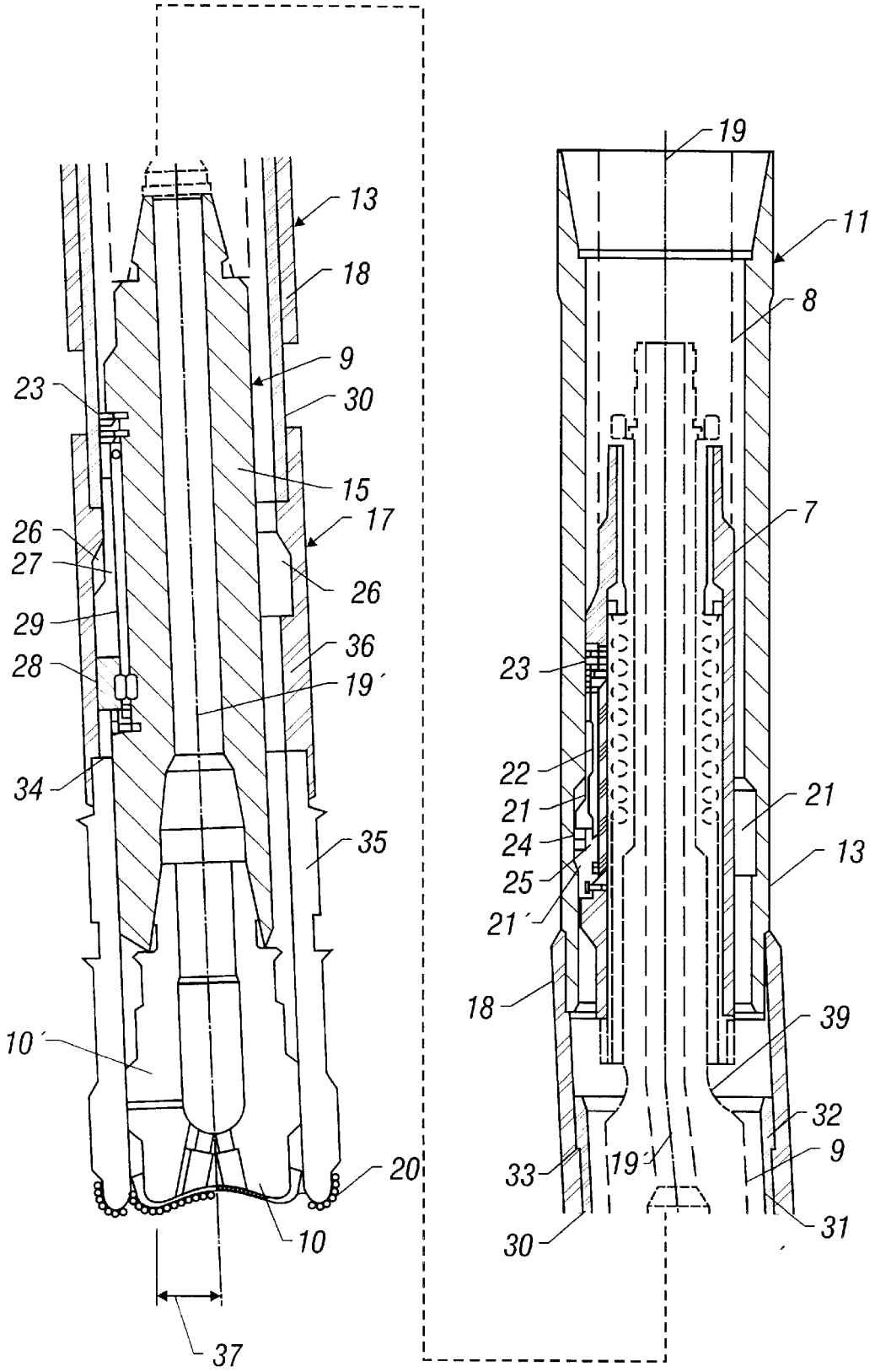
FIG. 5 is a plan view similar to FIG. 2 showing a second embodiment of drilling tool according to the invention.

Whereas the drilling tool according to FIGS. 1 to 4 is constructed for sinking straight bore holes 2, the further embodiment of drilling tool according to FIG. 5 permits of directional bores in underground formations. This is made possible in that, with an otherwise unchanged construction of the outer casing 11, the bottom end portion 18 of the upper main part 13 of the outer casing 11 is aligned at an acute angle 37 of for example 1° to 3° to the main part 13 situated above it. This can be brought about for instance by an angled alignment of the screw thread 38 at the bottom end of the main part 13 of the outer casing 11 onto which the bottom end portion 18 is screwed. Instead, a separate angled piece can also be supplied as a transition part which can be screwed in between.

In order to ensure that the drilling tool 4 can occupy its extreme low position in the outer casing 11, for an otherwise unchanged construction of the drilling tool 4, the drive shaft 9 of the deep drilling motor 8 is provided with a portion 39 of enhanced flexibility in the form of an encircling constriction which reduces the flexural resistance and which imparts a universal resilient deflectability to the downwardly adjacent part of the drive shaft 9. When the drilling tool 4 is in its extreme low position in the outer casing 11, the flexible portion 39 is disposed slightly below the angled part 40 at which the longitudinal central axis 19 of the drilling tool merges into the angled-over bottom part 19'.

In principle, any type of bit can be used as the drill bit 10. However, what is essential is that the drill bit 10 should be provided with a stabiliser part 10' situated at a short distance from and opposite the inside face of the bottom portion 35 of the bottom end part 17 and have a lateral cutting surface which has a high level of fitment precision, for instance by being overground and being capable of engaging through the drill head 20 with a close fit.

For sinking a bore in underground formations, the pattern and composition of which is generally known by precedent geological investigations, initially a first part of a bore hole 2 is drilled cut with the aid of an ordinary drilling tool similar to the drilling tool 4 which extends through any first formation, for example one formed by shale, as far as the vicinity of the interface with a special formation following it in the sinking direction, in which the formation pressure is substantially higher or lower than in the area of the first formation. This first formation which has substantially the same first formation pressure may have a substantially homogeneous structure but it may however also consist of a plurality of different partial formations between which there are no substantial differences in formation pressure.

Once this first part of the bore hole 2 has been sunk, the normal drilling tool is withdrawn and into the bore hole 2 is lowered the outer casing 11, of which the length is such that it exceeds the previously ascertained thickness of the next special formation in succession. This special formation can for example be one which has a high formation pressure such as is the case for example with superimposed strata over gas or oil deposit strata. At this point in time, after the outer casing 11 the top end of which is supported at the drilling tower has been lowered into the bore hole 2, the drilling tool 4 is now introduced into the outer casing 11 as the casing string 3 is progressively made up, until the drilling tool 4 has reached an extreme low position in the outer casing 11, this position being defined by the top group 14 of locking members 21, 22 and is secured in this position, any further downwards movement being prevented. In this extreme low position, as it is shown in FIG. 2, a connection between the drive shaft 9, 15 and the bottom end part 17 of the outer casing 11 is established via the locking members 26, 27 of the bottom group 16 and, when drilling starts, this connection ensures that drive shaft 9 and bottom end part 17 of the outer casing 11 rotate jointly about the longitudinal central axis 19 of the drilling tool and so cause the drill bit 10 and drill head 20 to rotate jointly.

As soon as the drilling tool 4 has been set down in the outer casing 11 and locked, the top end of the outer casing 11 is connected to the casing string 3 by means of the connecting device 12 which may be of any suitable known construction and afterwards separated from the drilling tower support. The resulting unit comprising parts 3, 4 and 11 is, then, with further construction of the casing string 3, introduced farther into the first part of the bore hole 2 until drill bit 10 and drill head 20 reach the bottom of the bore hole 2. Then, the drilling tool 4 is put into operation by switching on or starting up the deep drilling motor 8 which, if it is constructed as a turbine or as a Moineau motor, can for instance be set in motion by having drilling mud applied to it. This is supplied through the central drilling mud channel 14 in the drill line from the surface and after it has flowed through the central drilling mud channel 14, it emerges from the end of the drill bit 10 and passes into the bore hole 2 so that it can subsequently flow back to the surface through the annular space between the drilling tool and the walls of the bore hole.

Upon subsequent sinking of a further part of the bore hole 20 through at least the special formation, the casing string 3 entrains the tubular outer casing 11 with it, whereby, by virtue of the drill head 2 rotating at the bottom end of the outer casing 11, this latter for its part acts as a drilling tool. In the region of its length, the outer casing 11 lines the bore hole 2, absorbs inwardly directed forces exerted by the formation, as soon as these take effect for example when there is a drop in the drilling mud pressure, and creates a seal which can possibly be completed by cementing in.

After traversing the special formation, if the bore hole has reached its target, for example a gas or oil deposit, then once the connecting device 12 has been released, the drilling tool can be withdrawn and the bore used for example as a production bore, for example after lining is completed. If the bore hole is to extend far beyond the special formation, then after withdrawal of the drilling tool 4 which was previously connected to the outer casing 11, a second drilling tool together with a casing string, can be inserted into the bore hole through the set-down outer casing and can take over further sinking of the bore. In this case, if upon further sinking a further special formation has to be drilled through at a considerable distance from the first special formation, then a second drilling tool with a second outer casing can be brought into action, being fed through the positioned first outer casing. The performance of the drilling process with the second drilling tool takes a similar form to that previously described.

In cases where a plurality of special formations follow one another at relatively close intervals in the sinking direction, it may be expedient to drive the outer casing through all the special formations and accordingly extend the bore hole lining over all the special formations.

When sinking straight bores while jointly feeding the outer casing 11, the main top part 13 of the outer casing 11 is advantageously caused to rotate by the casing string 3 for the purpose of reducing friction or for rectilinear guidance of the drilling tool 4. If the outer casing 11 is angled over in its bottom part so that the drilling tool can be used for directional drilling operations, then after the directional pattern of the angled-over part of the outer casing 11 has been determined, this is locked against rotation from the surface, by the casing string 3, so that as drilling proceeds, a bore hole part is drilled out which is altered accordingly in its direction.

We claim:

1. A method of drilling a borehole in underground formations with at least one specified formation, the method comprising:

(a) using a drilling tool carried at the bottom of a drill string, said drilling tool comprising a drill bit, to drill out a first part of a borehole which extends to a point close to the boundary of the at least one specified formation;

(b) operatively coupling, in a fixed manner, a tubular outer casing to the drill bit, said tubular outer casing having a bottom end with a drill head therein encircling the bit;

(c) coupling the tubular outer casing to a casing string on the drill string; and (d) lining the bore hole with the tubular outer casing while continuing to drill the borehole with the drill bit and the drill head at least until the drill bit has passed through the at least one specified formation;

wherein the outer casing and the drilling tool placed therein form a directional drilling tool and are used for directional drilling.

2. The method according to claim 1, further comprising:

(a) withdrawing the drill string from the borehole together with the drilling tool;

(b) inserting the tubular outer casing carrying the drill head at the bottom end into the bore hole to a length which exceeds a previously ascertained thickness of the at least one specified formation;

(c) inserting and lowering the drilling tool together with a tubular rod into the outer casing until the drilling tool is in an extreme low position in which the drill head and the drill bit are approximately at the same height;

(d) connecting the top end of the outer casing is connected to the casing string;

(e) lowering the casing string together with the outer casing farther into the borehole until it reaches the bottom of the borehole; and (f) using the drill bit and the bottom end part of the outer casing which carries the drill head in a common drilling operation.

3. The method according to claim 1, wherein the at least one specified formation consists of one specified formation the method further comprising (a) disengaging the outer casing from the casing string;

(b) pulling up the casing string together with the drilling tool; and (c) continuing further drilling with a second drilling tool which together with the casing string can be passed through the outer casing.

4. The method according to claim 1, wherein the at least one specified formation consists of a plurality of adjacent or relatively closely spaced formations and wherein the step of continuing to drill the borehole is continued through all the specified formations.

5. The method according to claim 1, wherein the outer casing is cemented in its intended position in the bore hole.

6. The method according to claim 1, an upper main part of the outer casing is rotated by the casing string.

7. In a borehole having a plurality of specified formations that are spaced apart from each other, and wherein the borehole has been drilled to the bottom of at least one specified formation of said plurality of specified formations using (i) a first drilling tool having a drill bit on a drill string and (ii) a drill head on a first outer casing coupled to a casing string, said drill head encircling the drill bit, a method of further drilling the borehole comprising:

(a) suspending the drilling of the borehole;

(b) decoupling the outer casing from the casing string;

(c) withdrawing the drill string with the drilling tool from the borehole;

(d) resuming drilling of the borehole with a second drilling tool passing through the first outer casing together with the casing string to a point close to the boundary of a second specified formation;

(e) withdrawing the drilling tool and the casing string from the borehole;

(f) coupling a second outer casing provided with a drill head to the casing string;

(g) placing the second drilling tool in the second outer casing; and (h) continuing to drill the bore hole at least until the second specified formation is traversed.

8. The method according to claim 7, wherein at least one of the outer casings is cemented in its intended position in the bore hole.

9. The method according to claim 7, wherein an upper main part of each of the outer casings is rotated by the casing string.

10. An apparatus for drilling a borehole in underground formations with at least one specified formation comprising:

(a) a casing string;

(b) a drilling tool which comprises a tubular tool housing adapted to be connected to an upper end of a bottom end of the casing string;

(c) a drilling motor and a drill bit mounted on an end of a drive shaft of the drilling motor, said drill bit projecting beyond the bottom end of the tool housing;

(d) an outer casing of a length exceeding at least the thickness of the at least one specified formation;

(e) a drill head at the bottom end of the outer casing;

(f) a connecting device at the top end of the outer casing which can be engaged and disengaged for fixing the outer casing on the casing string;

(g) a first locking member adapted to brace the casing string in an extreme low position in the outer casing; and (h) a second locking member adapted to connect the drive shaft of the drilling motor to an independently rotatable mounted end part of the outer casing for common rotary movement;

wherein the outer casing and the drilling tool placed therein form a directional drilling tool and are used for directional drilling.

11. The apparatus according to claim 10, wherein the first locking member presets on the drilling tool an extreme low position in the outer casing with the drill bit is at the level of the drill head of the outer casing.

12. The apparatus according to claim 10, wherein the first locking member further comprises a locking groove constructed in the outer casing in the form of an outwardly shaped annular pocket and a locking strip pivotally mounted on the tool housing and which can be swung by spring action out of a concealed starting position into a locking position in which the locking strips engage the locking grooves and are in axial bracing engagement with the bottom of the pocket.

13. The apparatus according to claim 12, wherein the locking groove of the first locking member comprises an engagement length which is shorter than that of the engagement parts of the locking strips of the second locking member.

14. The apparatus according to claim 12, wherein the locking grooves of the second locking member have an engagement length which is greater than that of the engagement parts of the locking strips of the first locking member.

15. The apparatus according to claim 10, wherein the second locking member further comprises, constructed in the bottom end part of the outer housing, longitudinally directed locking grooves in the form of pockets with which are outwardly shaped like channels and locking strips pivotally mounted on the drive shaft of the drilling motor and which are adapted to be folded from a recessed starting position by spring action into a locking position in which the locking strips engage the locking grooves.

16. The apparatus according to claim 10, wherein the bottom end part of the outer casing which is rotatably mounted on the upper main part of the outer casing is adapted for axial displacement out of a low starting position into a drilling position in which the cutting plane of the drill head is offset upwardly in respect of the drill bit and engages around the drill bit in the region of its lateral cutting edge.

17. The apparatus according to claim 10, wherein the bottom end part and the bottom end of the upper main part of the outer casing engage around a bearing sleeve which is rigidly connected to the bottom end part and is braced for limited axial displacement in the bottom end of the upper main part of the outer casing.

18. The apparatus according to claim 10, wherein the bottom end of the upper main part of the outer casing has an angled-over orientation while the drive shaft of the drilling motor is provided with a flexible portion which imparts a resilient universal deflectability to the downwardly adjacent part of the drive shaft.

19. The apparatus according to claim 18, wherein the flexible portion of the drive shaft is situated close to the angled part.

20. The apparatus of claim 10, wherein a length equalizing and pressure device is disposed above the drilling tool.

21. An apparatus for drilling a borehole in underground formations with at least one specified formation, the method comprising:

(a) a drilling tool carried at the bottom of a drill string, said drilling tool comprising a drill bit, said drilling tool adapted to drill out a first part of a borehole which extends to a point close to the boundary of the at least one specified formation;

(b) a tubular outer casing having a bottom end with a drill head therein, the drill head encircling the drill bit, said tubular casing being adapted to be operatively coupled in a fixed manner to the drill bit and to a casing string on the drill string, the tubular casing further adapted to line the borehole while the drill bit and the drill head drill through the at least one specified formation;

wherein the outer casing and the drilling tool placed therein are adapted to form a directional drilling tool.

* * * * *